US005126066A

United States Patent [19]

Torenbeek et al.

[11] Patent Number: 5,126,066

[45] Date of Patent: Jun. 30, 1992

[54] STABLE, POURABLE AQUEOUS BLEACHING COMPOSITIONS COMPRISING SOLID ORGANIC PEROXY ACIDS AND AT LEAST TWO POLYMERS

[75] Inventors: Reinder Torenbeek, Terwolde; Jan J. H. Ploumen, Roermond, both of Netherlands

[73] Assignee: Akzo N.V., Arnhem, Netherlands

[21] Appl. No.: 639,304

[22] Filed: Jan. 2, 1991

Related U.S. Application Data

[63] Continuation of Ser. No. 368,507, Jun. 20, 1989, abandoned.

[30] Foreign Application Priority Data

Jun. 22, 1988 [EP] European Pat. Off. ..... 88109925.3

[51] Int. Cl.[5] ..... C11D 3/22; C11D 3/39; C11D 7/38; C11D 7/54

[52] U.S. Cl. ..... 252/95; 252/94; 252/174.17; 252/174.18; 252/174.23; 252/174.24; 252/173; 252/186.26; 252/186.42

[58] Field of Search ..... 252/95, 186.26, 186.42, 252/174.17, 94, 174.18, 174.23, 174.24, 173

[56] References Cited

U.S. PATENT DOCUMENTS

| | | | |
|---|---|---|---|
| 3,996,152 | 12/1976 | Edwards et al. | 252/186.26 |
| 4,232,141 | 11/1980 | Koyanagi et al. | 526/344.2 |
| 4,547,308 | 10/1985 | Torenbeek | 252/186.26 |
| 4,634,551 | 1/1987 | Burns et al. | 252/102 |
| 4,681,592 | 7/1987 | Hardy et al. | 8/111 |
| 4,790,949 | 12/1988 | Dankowski et al. | 252/95 |
| 4,842,765 | 6/1989 | Satomi | 252/186.26 |
| 4,879,057 | 11/1989 | Dankowski et al. | 252/99 |

FOREIGN PATENT DOCUMENTS

| | | |
|---|---|---|
| 160342 | 11/1985 | European Pat. Off. . |
| 176124 | 4/1986 | European Pat. Off. . |
| 200163 | 11/1986 | European Pat. Off. . |
| 201958 | 11/1986 | European Pat. Off. . |
| 254331 | 1/1988 | European Pat. Off. . |
| 267175 | 5/1988 | European Pat. Off. . |
| 1535804 | 12/1978 | United Kingdom . |

OTHER PUBLICATIONS

Grant & Hackh's Chemical Dictionary, 5th Edition; 1987, p. 121.

Kirk-Othmer Encyclopedia of Chemical Technology, Third Ed., vol. 12, 1980, pp. 45-64.

"Xanthan Gun/Keltrol/Kelzan/A Natural Biopolysaccharide for Scientific Water Control", Printed by Kelco, a division of Merck & Co., Inc., 1976, 2nd Ed. pp. 8, 9 and 28.

Ullman's Encyclopedia of Industrial Chemistry, Fifth Ed., vol. A5; pp. 461-487.

Chemical Abstracts 106:69183m, 1987.

*Primary Examiner*—Paul Lieberman
*Assistant Examiner*—Erin M. Higgins
*Attorney, Agent, or Firm*—Louis A. Morris; David H. Vickery

[57] ABSTRACT

This disclosure relates to pourable bleaching compositions comprising a solid substantially water-insoluble organic peroxy acid stably suspended in an aqueous medium containing at least two polymers wherein the first polymer is one or more natural gums and the second polymer is selected from the group consisting of polyvinyl alcohol, one or more cellulose derivatives and mixtures thereof. The bleaching composition also may contain an electrolyte. The preferred organic peroxy acid is 1,12-diperoxydodecanedioic acid. The preferred first polymer is xanthan gum. The second polymer is preferably a cellulose ether.

12 Claims, 1 Drawing Sheet

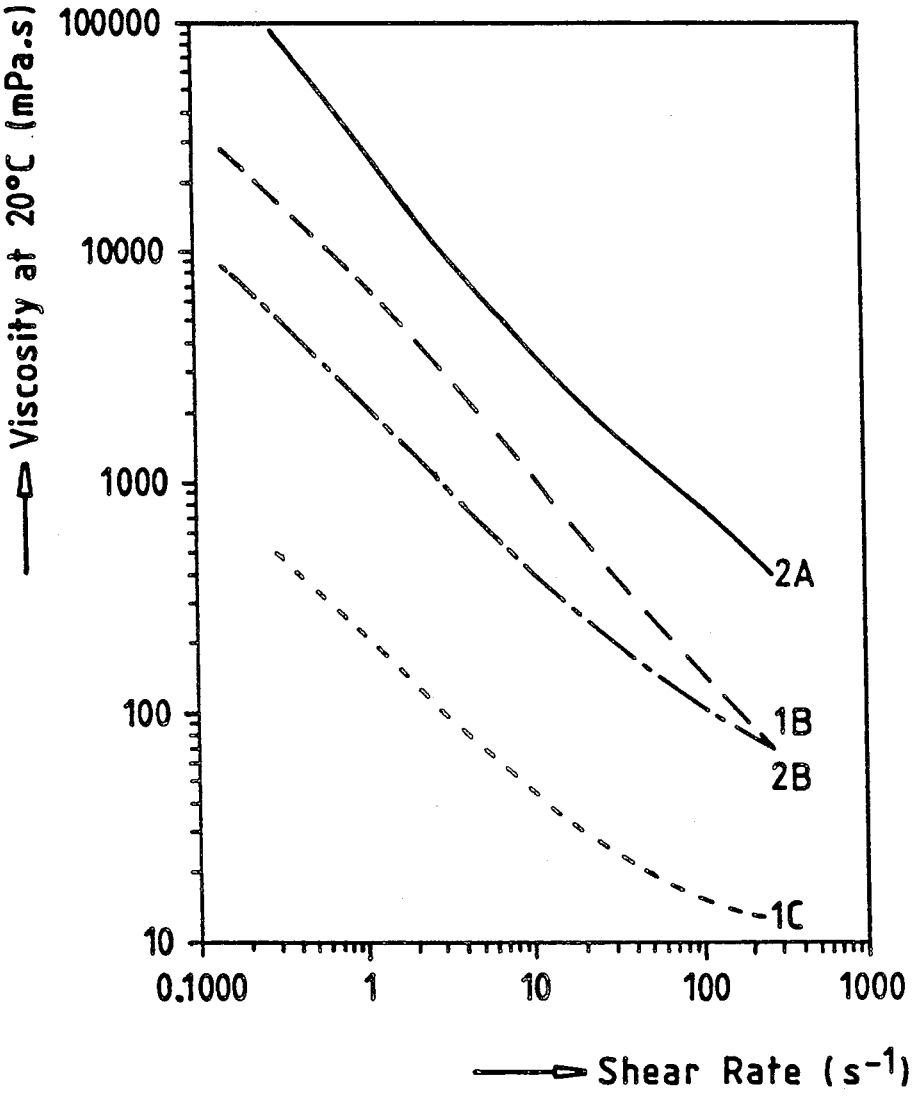
Viscosity at 20°C (mPa.s)
100000
10000
1000
100
10
0.1000
1
10
100
1000
Shear Rate (s-1)
2A
1B
2B
1C

STABLE, POURABLE AQUEOUS BLEACHING COMPOSITIONS COMPRISING SOLID ORGANIC PEROXY ACIDS AND AT LEAST TWO POLYMERS

This is a continuation of application Ser. No. 07/368,507 filed Jun. 20, 1989; now abandoned.

FIELD OF THE INVENTION

The invention relates to pourable bleaching compositions comprising a solid, substantially water-insoluble organic peroxy acid stably suspended in an aqueous medium The bleaching compositions of the current invention may be used alone or in combination with other bleaches Additionally, the current bleaching compositions may be included as part of detergent, bleaching, cleaning and/or disinfecting formulations.

BACKGROUND OF THE INVENTION

Bleaching compositions comprising a solid, substantially water-insoluble organic peroxy acid stably suspended in an aqueous medium are generally known from British Patent Specification 1,535,804. It claims fabric bleaching compositions having a viscosity from 200 to 100,000 cp. and a non-alkaline pH, the compositions comprising an aqueous carrier, 1–40 weight % particulate organic substantially water-insoluble peroxygen compound and a thickening agent. Specifically mentioned thickening agents are inorganic thickeners, such as clays, and organic thickeners, such as water-soluble gums, mucilaginous materials starches, polyacrylamides and carboxylpolymethylene. In particular, British Patent Specification 1,535,804 discloses the use of cellulose derivatives such as carboxymethyl celluloses, hydroxypropyl cellulose and methyl hydroxybutyl cellulose, hydrolyzed proteins such as hydrolyzed keratins, glutens, polyvinyl alcohol and polyvinylpyrrolidone and natural gums such as gum arabic, carrageen and various agars.

Further, the non-prepublished European Patent Application No 283,792 discloses storage-stable, pourable aqueous bleach suspensions having a pH value in the range of 1 to 6 and containing (a) particulate, water-insoluble peroxy-carboxylic acid (e.g., diperoxydodecanedioic acid), (b) xanthan gum or agars, (c) hydratable neutral salt (e g., $Na_2SO_4$), (d) optionally an acid for pH regulation (e.g . $H_2SO_4$), and (e) aqueous liquid.

It is known to be advantageous to use liquid bleaching compositions rather than solid bleaching compositions in automatic clothes washers and dryers. Among those advantages is that with liquid bleaching compositions there is no need for cost-increasing shaping steps, such as granulating and drying. Additionally, liquid bleaching compositions are more easily dispersed in wash liquor or in an automatic clothes dryer so the fabrics are more rapidly and evenly bleached. Uneven bleaching can damage fabric as a result of localized high concentrations of bleaching agent.

As disclosed in European Patent Application 176 124, the bleaching compositions of GB 1 535 804, at least as far as they are pourable, have the disadvantage that they are not physically stable. As shown by Composition 7 in EP 176 124, after prolonged storage, pourable bleaching compositions of GB 1 535 804 undergo phase separation, producing a thick bottom layer which is difficult to disperse or homogenize. Consequently, the aforementioned advantage of even fabric distribution may be partly eliminated.

Further it should be mentioned that GB 1,535,804 does not disclose or suggest the use of more than one thickening agent in a single fabric bleaching composition. Indeed, it is clear from Example III of GB 1,535,804 that the cellulose derivatives tested as thickening agents were tested in individual, separate bleach compositions. Additionally, the bleach composition of Example III of GB 1,535,804 is a "thick, semi-gelatinous composition" (see page 11, lines 32–35 of GB 1,535,804) rather than a pourable composition of the present invention.

It should be noted that U.S. Pat. No. 4,232,141 (NL 707,916) discloses, inter alia, grinding coarser particles of a polymerization initiator in an aqueous medium containing a dispersing agent to form an aqueous dispersion of the polymerization initiator. The polymerization initiator may be, inter alia, a peroxy dicarbonate or a benzoyl peroxide. Claim 9 claims that the dispersing agent may be polyvinyl alcohol, cellulose ether, gelatine or a mixture thereof. However, only single dispersing agents (either polyvinyl alcohol or methyl cellulose) are used in the working examples of U.S Pat. No. 4,232,141 to form polymerization initiator dispersions. These dispersions were then added to vinyl chloride polymerization suspensions to form polyvinyl chloride. Some vinyl chloride polymerization suspensions of the examples of U.S. Pat. No. 4,232,141 contain a mixture of polyvinyl alcohol and methyl cellulose. However, as demonstrated herein below, an aqueous suspension acceptable under bleaching conditions (pourability, physical stability and chemical stability) and prepared as suggested by U.S. Pat. No. 4,232,141 is not physically stable.

Further, the product brochure "Xanthan Gum/Keltrol/Kelzan/a natural biopolysaccharide for scientific water control" (printed by Kelco, a division of Merck & Co., Inc 1976, Second Edition) teaches at pages 8 and 9 that "[x]anthan gum is compatible with most commercially available thickeners, both synthetic and natural". However, the brochure also teaches that "[t]he use of xanthan gum with cellulose derivatives is generally not recommended". Thus, the brochure does not mention the use of xanthan gum with polyvinyl alcohol and specifically teaches against the use of xanthan gum with cellulose derivatives.

It has been surprisingly found that a pourable bleaching composition may be formed comprising a solid, substantially water-insoluble organic peroxy acid stably suspended in an aqueous medium, the aqueous medium also comprising at least two polymers wherein the first polymer is one or more natural gums, such as xanthan gum, and the second polymer is selected from the group consisting of polyvinyl alcohol ("PVA"), cellulose derivatives and mixtures thereof. The term "mixtures thereof" includes mixtures of only cellulose derivatives as well as mixtures of one or more cellulose derivatives with PVA. The composition may also comprise an electrolyte, such as $Na_2SO_4$.

To be useful, the current bleaching compositions should be conveniently pourable and relatively stable, both chemically and physically.

The bleaching compositions of the current invention are conveniently pourable when they may be poured relatively easily and smoothly from small containers (e g. household size, approx. 0.1 to 2.0 liters) and large containers (e.g. industrial and bulk transport size).

Quantifying the "pourability" of the current bleaching compositions is difficult since the compositions are non-Newtonian fluids. With non-Newtonian fluids the shear stress (an indication of a fluid's resistance to flow and therefore its Pourability) varies with the shear rate. For example, some non-Newtonian fluids may have very little initial resistance to flow and pour easily and smoothly. The preferred current bleaching compositions have such flow behavior for both large and small containers. However other non-Newtonian fluids may have substantial initial resistance to flow and then pour easily and smoothly, as with tomato ketchup. Non-Newtonian fluids may also be gel-like and offer both initial and continued resistance to flow. Initial resistance to flow may be referred to as a fluid's "yield value". Generally, bleaching compositions having little or no yield value are preferred; that is, they are conveniently pourable. As one advantage of the current two-polymer bleaching composition, it is possible to prepare stable aqueous suspensions of substantially water-insoluble organic peroxy acid having little yield value. Although viscosity measurements do not precisely measure either the pourability or the yield value of non-Newtonian fluids, viscosity measurements do indicate the relative thickness and thus the relative pourability of non-Newtonian fluids. The Brookfield method is one well-known way to measure the viscosity of a fluid. However, the Brookfield method does not measure shear rate. Since the viscosity of a non-Newtonian fluid is shear rate-dependent, Brookfield viscosity provides only a relative indication of the viscosity of a fluid. In general, though non-limiting, bleaching compositions of the current invention are "pourable" if the Brookfield viscosity is below about 2000 mPa.s (Brookfield 20 r.p.m.) and preferably below about 1500 mPa.s (Brookfield, 20 r.p.m.).

On the other hand, with the appropriate equipment (such as a Haake Rotorisco RV 100), it is possible to measure the shear stress and the shear rate of a non-Newtonian fluid. Such data may be used to predict the yield values of such fluids. Further, viscosity may be calculated from the stress and shear rate data. A plot of viscosity versus shear rate data produces a "rheogram". Since the viscosity of a non-Newtonian fluid is shear rate-dependent, a rheogram provides a more accurate viscosity profile and therefore a better indication of the "pourability" of non-Newtonian fluids. The above-referenced product brochure "Xanthan Gum/Keltrol/-Kelzan/a natural biopolysaccharide for scientific water control" provides the shear rate values acting on solutions of xanthan gum as they are poured from a bottle over the shear rate range of about 10–100 $s^{-1}$ (see page 28).

The bleaching compositions of the current invention are chemically stable when the activity of the organic peroxy acid undergoes insignificant, and preferably no, reduction over a reasonable storage time. One measure of the potential bleaching activity of an organic peroxy acid, or a composition containing an organic peroxy acid, is the active oxygen (A.O.) content. However, "active oxygen" is affected by the presence of $H_2O_2$ as well as peroxy acid. Therefore, a more accurate indication of chemical stability after storage is "residual peroxy acid" which is active oxygen minus $H_2O_2$.

The bleaching compositions of the current application are physically stable when the compositions undergo insignificant, and preferably no, phase separation during a reasonable storage time.

SUMMARY OF THE INVENTION

The present invention relates to bleaching compositions comprising a solid, substantially water-insoluble organic peroxy acid stably suspended in an aqueous medium, said aqueous medium comprised of at least two polymers wherein the first polymer is one or more natural gums, preferably xanthan gum and the second polymer is selected from the group consisting of polyvinyl alcohol, cellulose derivatives and mixtures thereof. The bleaching composition may additionally be comprised of an electrolyte, such as $Na_2SO_4$.

BRIEF DESCRIPTION OF THE DRAWING

FIG. 1 is a rheogram of the Test Suspensions 1B and 1C of Example 1 and the suspensions of Example 2 and Table 2.

DETAILED DESCRIPTION OF THE INVENTION

The solid, substantially water-insoluble organic peroxy acids which may be used in the bleaching compositions of the current invention are generally known in the art. As non-limiting examples, the solid organic peroxy acids disclosed in European Patent Applications 160,342; 176,124 and 267,175, U.S. Pat. Nos. 4,681,592 and 4,634,551 and GB Patent Specification 1,535,804 may be used and are all herein incorporated by reference. The most preferred organic peroxy acids which may be used in the compositions of the current invention are (1) diperoxy acids, such as 1,12-diperoxydodecanedioic acid ("DPDA"), diperazelaic acid and 1,13 diperoxytridecanedioic acid, (2) peroxy acids which have a polar amide link in the hydrocarbon chain, such as N-decanoyl-6-aminoperoxyhexanoic acid, N-dodecanoyl 6-aminoperoxyhexanoic acid, 4-nonylamino4-oxoperoxybutyric acid and 6-nonylamino-6-oxoperoxyhexanoic acid, and (3) alkyl sulphonyl peroxycarboxylic acids, such as heptyl sulphonyl perpropionic acid, octyl sulphonyl perpropionic acid, nonyl sulphonyl perpropionic acid and decyl sulphonyl perpropionic acid. Methods for preparing such preferred organic peroxy acids are known in the art and in particular from the above cited references. Optionally, the solid organic peroxy acid may be coated with a water-impermeable material, such as the fatty acids lauric acid, myristric acid and mixtures thereof, as known from European Patent Application 254,331. The amount of organic peroxy acid in the current bleaching formulations depends on criteria such as the active oxygen ("A.O.") content of the peroxy acid and the intended use of the bleaching composition. The preferred amount of peroxy acid is that which will provide effective washing, bleaching, cleaning and/or disinfecting in a diluted use liquor. Generally, though non-limiting, the current bleaching compositions have a peroxy acid concentration which will provide an A.O. content of between about 1 and about 200 ppm, and preferably between about 2 and about 100 ppm in a typical diluted liquor for use in washing, bleaching, cleaning and/or disinfecting.

The first polymer is one or more natural gums. As non-limiting examples, the natural gums may be xanthan gum, guar gum, gum arabic, carrageen and agars obtained from seaweed. Xanthan gum is the preferred natural gum. The amount of natural gum desired in the current bleaching formulations is the amount which is effective to provide a physically and chemically stable, pourable aqueous formulation. Generally, though non-limiting, natural gum is present as about 0.1 to about 1 wt % of the bleaching composition.

The second polymer is selected from the group consisting of polyvinyl alcohol, one or more cellulose derivatives and mixtures thereof. A group of cellulose derivatives particularly useful are cellulose ethers. Cellulose ethers are known from, for example, *Ullmann Encyclopedia of Industrial Chemistry*, Fifth Edition, Vol. A5, pages 461–487. Of particular use in the current bleaching compositions are methyl cellulose, methyl hydroxypropyl cellulose, methyl hydroxybutyl cellulose, hydroxyethyl cellulose and carboxymethyl cellulose. The amount of second polymer incorporated in the current bleaching formulations is the amount which will provide a physically and chemically stable, pourable aqueous bleaching composition. Generally, though non-limiting the second polymer is present as about 0.02 to about 2 wt. % of the bleaching composition.

An electrolyte may also be present in the aqueous medium to help provide a useful, pourable bleaching composition. The electrolyte may result from the residual acid present in the peroxy acid as a result of the peroxidation reaction. The electrolyte may also be added deliberately to enhance the physical stability of the current suspensions and increase their safe handling (See European Patent Application 176 124). Examples of suitable electrolytes are $Na_2SO_4$, $K_2SO_4$, $MgSO_4$, $Al_2(SO_4)_3$ and borate salts. The amount of electrolyte present depends, inter alia, on the peroxy acid and the polymers employed and on the intended use of the suspension. However, in general, though non-limiting, the electrolyte may be up to about 30 wt % of the composition.

Optionally, the current bleaching compositions may also comprise antifreezing agents, such as glycol.

The bleaching compositions of the current invention are further illustrated by the following non-limiting examples.

EXAMPLE 1

(COMPARATIVE EXAMPLE)

This example illustrates the problems presented by aqueous organic peroxy acid suspensions which contain no polymer or which contain only one water-soluble polymer. Test suspensions of 500 grams were prepared by mixing 274 grams organic peroxy acid (1,12-diperoxydodecandioic acid ("DPDA") in wet filter cake form, having an active oxygen (A.O.) content of 5.47%) with a solution of 15 grams $Na_2SO_4$ and 1 gram test polymer (if present) based on active material in 210 grams water. This produced test suspensions having an active oxygen content of 3 0%. The viscosity of each test suspension was measured (Brookfield RV, 20 r.p.m.) and the physical stability (in terms of phase separation) was monitored during an 8 week 20° C. storage period. The results are contained in Table 1.

TABLE 1

| Test Suspension | Water-soluble Polymer | Viscosity (mPa.s) | Phase Separation |
|---|---|---|---|
| 1A | None | 2400 | None |
| 1B | Xanthan gum (Rhodigel ® 23 from Rhone Poulenc) | 1700 | Small amount |
| 1C | Hydroxyethyl cellulose (Natrosol ® 250 L from Hercules) | 50 | Large amount |

As shown in the results in Table 1, even though the addition of the water-soluble polymer hydroxyethyl cellulose substantially reduces the test suspension viscosity, making it conveniently pourable, the phase separation is unacceptable. The addition of xanthan gum alone to the test suspension reduces viscosity, but not enough to provide acceptable pourability. Also, Test Suspension IB is not physically stable as indicated by the phase separation.

EXAMPLE 2

To have use as a bleaching composition, the suspensions of the current invention must be chemically stable as well as pourable and physically stable. That is, the bleaching ompositions of the current invention must retain their ability to bleach while they are being stored prior to use. The chemical stability of a peroxy acid is indicated by the retention of active oxygen (A.O.). However, active oxygen is affected by the presence of $H_2O_2$ as well as peroxy acid (such as DPDA). $H_2O_2$ is formed by the decay reactions of peroxy acids. Therefore, a more accurate indication of chemical stability after storage is the "residual peroxy acid", or in this case, "residual DPDA". "Residual DPDA" is the active oxygen content (A.O.) minus $H_2O_2$ formed by the decay of the peroxyacid. The $H_2O_2$ content was determined by extraction with a mixture of diethyl ether and water, separation of the water layer, addition of Ti(IV) reagent and spectrophotometric measurement of the yellow complex formed.

Two 500 gram test suspensions were independently prepared by mixing 274 grams DPDA filter cake (A.O. = 5.47%) in about 200 grams of water. The first suspension was completed by adding 15 grams $Na_2SO_4$ and 0.25 gram Dequest ® 2010 (a sequestering agent available from Monsanto). The second suspension was completed by adding 15 grams $Na_2SO_4$, 0.25 grams Dequest 2010, 1 gram hydroxyethyl cellulose (Natrosol 250 L) and 1 gram xanthan gum (Rhodigel 23). The initial active oxygen content and viscosity of each suspension were measured. Each suspension was divided in half. One half of each suspension was stored for 8 weeks at 20° C. and the other half stored for 8 weeks at 30° C. The chemical stability (active oxygen loss and residual DPDA), the rheology (viscosity) and the physical stability (phase separation) data are in Table 2 below.

TABLE 2

| | Suspension Without Polymers (Suspension 2A) | Suspension With Xanthan Gum and Hydroxyethyl Cellulose (Suspension 2B) |
|---|---|---|
| Loss in Active Oxygen (8 weeks at 30° C.) | <1% | <1% |
| Residual DPDA | | |
| After 8 weeks at 20° C. | 99% | 98% |
| After 8 weeks at 30° C. | 96% | 95% |
| Phase Separation | | |
| After 8 weeks at 20° C. | none | none |
| After 8 weeks at 30° C. | none | none |
| Viscosity (Brookfield RV, 10 rpm) in mPa.s | | |
| Initially | 9500 | 650 |

TABLE 2-continued

| | Suspension Without Polymers (Suspension 2A) | Suspension With Xanthan Gum and Hydroxyethyl Cellulose (Suspension 2B) |
|---|---|---|
| After 8 weeks at 20° C. | 9800 | 580 |

Surprisingly, the suspension of the current invention were conveniently pourable as well as being chemically and physically stable over the 8 week test period.

In order to compare and predict the rheological behavior ("pourability") of know compositions and compositions of the current invention, a plot of viscosity vs. shear rate ("rheogram") was generated for Test Suspensions 1B and 1C of Example 1 and for the suspensions of Example 2. The shear stress was recorded versus the shear rate applied with a Haake Rotovisco RV 100 at 20° C. The calculated viscosity values are plotted versus the shear rate in FIG. 1. Suspensions which follow the curve of Suspension 1B are not easily pourable as demonstrated by laboratory attempts to pour them without shaking the contents of the container. (Note that such lack of pourability was also indicated by the Brookfield viscosity measurement of Suspension IB as reported at Table 1.) However, suspensions which follow the curve of Suspension 2B are pourable. Liquid detergents currently available in Western Europe (therefore having commercially acceptable pourability) follow the curve of Suspension 2B and are of lower viscosity than Suspension 1B. As discussed in Example 1, Suspension 1C is pourable but not physically stable.

Additionally, from plots of shear stress versus shear rate, the yield value of Suspension 2A was found to be about 200 Pa while that of Suspension 2B was found to be about 15 Pa. For suspensions of the current invention, yield values between about 5 and about 20 Pa provide the most desirable "pourability" behavior.

EXAMPLE 3

(COMPARATIVE EXAMPLE)

A bleaching composition comprised of components suggested by the disclosure in U.S. Pat. No. 4,232,141 was prepared as a comparative example. A test suspension was prepared by mixing 326.1 grams DPDA wet filter cake (A.O. = 5.22%) with 193.9 grams of an aqueous solution of 0.25 gram Dequest 2010, 1.0 gram PVA (Gohsenol® KP-08, 75% hydrolyzed, available from Nippon Gohsei) and 1.0 gram hydroxyethyl cellulose (Natrosol 250 L available from Hercules). This produced a test suspension having an active oxygen content of 3.3%. Sodium sulfate was omitted from the composition since PVA precipitated from solution in the presence of $Na_2SO_4$ prior to the addition of DPDA. The viscosity of the test suspension was 89 mPa.s (Brookfield LVT, 30 r.p m.). After 8 weeks storage at 20° C., 160 ml of water separated from the test suspension.

EXAMPLE 4

A bleaching composition was prepared in accordance with the composition of Example 3 modified by the addition of 1.0 gram xanthan gum, placing the test suspension of this Example 4 within the scope of the current invention. The viscosity of the test suspension was 938 mPa.s (Brookfield LTV, 30 r.p m.). After 8 weeks storage at 20° C., only an insignificant 4 ml of water separated from the test suspension. The composition was conveniently pourable.

EXAMPLE 5

As disclosed in European Patent Application 254,331, organic peroxy acids may be prepared in such a manner that the resulting organic peroxy acid also comprises a water-impermeable material, such as fatty acid. The fatty acid may, among other things, increase the safe handling and use of organic peroxy acids.

Test suspensions using DPDA with lauric acid (a fatty acid) were prepared by mixing 206 grams DPDA coated with lauric acid (wet filter cake, A.O. = 6.07%) aqueous solutions containing varying amounts PVA or PVA and xanthan gum as set forth in Table 3 to form 500 gram aqueous suspensions. The lauric acid-coated DPDA was prepared substantially in accordance with the method of European Patent Application 254 331 by heating and stirring a suspension of DPDA at 50° C., adding lauric acid in a weight ratio of 3:1 DPDA to lauric acid, stirring for 10 minutes, cooling and separating the DPDA and lauric acid combination from water on a filter.

Again, the viscosity of each test suspension was measured (Brookfield RV at 20 r p m., except Test Suspension 3D which was measured at Brookfield LV at 60 r.p.m ) and the physical stability was monitored during an 8 week period at 20° C. The data are reported in Table 3.

Test Suspension 3A does not contain a water-soluble polymer. It does not separate over the 8 week period but it is not conveniently pourable. Test Suspensions 3B, 3C and 3D contain the water-soluble polymer PVA (as suggested by U.S. Pat. No. 4,232,141). They are conveniently pourable but have unacceptable phase separation. Test Suspension 3E, containing both xanthan gum and PVA according to the present invention, shows no phase separation, is as chemically stable as Test Suspension 3A and is conveniently pourable. Thus, the current bleaching compositions are suitable for use with organic peroxy acids which also comprise a water-impermeable material.

TABLE 3

| Test Suspension | Water-soluble Polymer(s) | Viscosity (mPa.s) | $H_2O$ Separation After 8 Weeks |
|---|---|---|---|
| 3A | None | 7600 | 0 |
| 3B | 0.5 g PVA (Gohsenol KP-08) | 905 | 38 |
| 3C | 1.0 g PVA (Gohsenol KP-08) | 421 | 42 |
| 3D | 2.0 g PVA (Gohsenol KP-08) | 43 | 139 |
| 3E | 1.0 g PVA (Gohsenol KP-08) and 1.0 g xanthan gum (Rhodigel) | 1360 | 0 |

EXAMPLE 6

For some purposes (such as bulk transportation), it is desirable to produce aqueous, pourable suspensions having relatively high peroxy acid concentration and/or active oxygen content. It has been surprisingly found that the bleaching compositions of the current invention are capable of containing substantially increased amount of organic peroxy acid on a weight percent basis.

For example, currently known aqueous suspensions of the organic peroxy acid DPDA are capable of a maximum of about 32 wt. % DPDA and have an active oxygen content of about 3 5%. In the case of aqueous suspensions of DPDA in combination with a water-impermeable material, such as a fatty acid (for example, lauric acid), the active oxygen content may be reduced to about 2.5%. Surprisingly, aqueous suspensions have been prepared using the polymer system of the current invention to produce bleaching compositions with substantially increased DPDA (with and without lauric acid) concentration and substantially increased active oxygen content. The details of these compositions are contained in Table 4.

TABLE 4

| | Suspension of DPDA Particles | Suspension of DPDA-Lauric Acid Particles |
|---|---|---|
| 1. Composition (wt. %) | | |
| DPDA | 43.5 | — |
| DPDA-Lauric Acid (3:1) | — | 40.7 |
| Hydroxyethyl cellulose (Natrosol 250 L) | 0.3 | — |
| Polyvinyl Alcohol (Gohsenol KP-08) | — | 0.4 |
| Xanthan Gum (Rhodigel) | 0.1 | 0.2 |
| Dequest 2010 | 0.05 | 0.05 |
| 2. Initial A. O. content of DPDA (%) | 11.5 | 8.6 |
| 3. Initial A. O. content of Suspension | 5.0 | 3.5 |
| 4. Chemical Stability | | |
| 8 weeks, 20° C. (Residual DPDA as % of Initial DPDA) | 96 | 98 |
| 8 weeks, 30° C. (Residual DPDA as % of Initial DPDA) | 95 | 97 |
| 5. Phase Stability 8 weeks, 30° C. | No Phase Separation | No Phase Separation |

EXAMPLE 7

Suspensions having relatively high peroxy acid concentrations (e.g., above about 20 wt. % for peroxyacids such as DPDA) are preferred for industrial purposes, such as bulk transportation and handling. However, relatively low peroxy acid concentrations (e.g., about 5-10 wt. % for peroxyacids such as DPDA for U.S. consumers) are desirable for household use. Therefore, it is most preferable that the previously described pourable, storage-stable concentrated suspensions can be diluted to form pourable, storage-stable dilute suspensions.

As provided in Table 5, two suspensions having relatively high peroxy acid concentrations (27 wt. %) were prepared. Suspension 5A is a comparative example containing peroxy acid and sodium sulfate. Suspension 5B is a two polymer formulation within the current invention. Comparative Suspension 5A was used to prepare 500 ml dilute Comparative Suspension 5C . Suspension 5B was used to prepare 500 ml dilute Suspension 5D according to the current invention. As reported in Table 5, dilute Suspension 5D is physically and chemically stable over a 4 week period while Suspension 5C separates after 3 weeks at 40° C. Chemical stability is reported in terms of "Residual DPDA". "Residual DPDA" was determined by the method described in Example 2, above.

TABLE 5

| Test Suspension* | pH | Water-Soluble Polymer(s) | Wt. % DPDA | Phase Stability (Separate Water Phase After 4 weeks, 40° C.) | Chemical Stability (Residual DPDA After 4 weeks, 40° C.) |
|---|---|---|---|---|---|
| 5A | — | None | 27 | Not Determined | Not Determined |
| 5B | — | 0.2 wt. % xanthan gum 0.2 wt. % hydroxyethyl cellulose | 27 | Not Determined | Not Determined |
| 5C | 3 | 0.5 wt. % xanthan gum | 6 | 50 ml | 90% |
| 5D | 3 | 0.5 wt. % xanthan gum 0.05 wt. % hydroxyethyl cellulose | 6 | 0 ml | 90% |

*All Test Suspensions contain 3 wt. % sodium sulfate. Test suspensions 5C and 5D contain 0.5 wt. % Dequest ® 2010 (a sequestering agent) and 3 wt. % boric acid.

EXAMPLE 8

This Example 8 demonstrates, inter alia, the effect of temperature on suspensions of the current invention.

Test suspensions 5C and 5D contain 0.05 wt. % Dequest ® 2010 (a sequestering) and 3 wt. % boric acid. industrial processing and transportation is likely to occur at lower temperatures (e g., about 10° C.-30° C.) while consumer storage and usage is likely to occur at higher temperatures (e g., about 20°-40° C.).

Test suspensions identical to those of Example 2 were prepared. Suspension 8A is identical to Suspension 2A. Suspension 8B is identical to Suspension 2B. Portions of the suspensions were stored for 8 weeks at 20° C., 30° C. and 40° C. then tested for chemical stability (residual DPDA), phase stability and rheological stability ("pourability"). Additionally, these characteristics were also monitored after 4 weeks for suspensions stored at 40° C. The results are provided in Table 6. It should be noted that "pourability" was determined by pouring (or attempting to pour) each suspension from a 500 ml container. Suspensions giving a streaming behavior similar to that of commercially available heavy duty detergents were "pourable".

TABLE 6

| | Suspension 8A (Without Polymers) | Suspension 8B (With Polymers) |
|---|---|---|
| Chemical Stability (Residual DPDA) | | |
| a. 8 weeks/20° C. | 99% | 98% |
| b. 8 weeks/30° C. | 96% | 95% |
| c. 4 weeks/40° C. | 93% | 92% |
| d. 8 weeks/40° C. | 84% | 79% |
| Phase Stability | | |
| a. 8 weeks/20° C. | No Phase Separation | No Phase Separation |
| b. 8 weeks/30° C. | No Phase Separation | No Phase Separation |
| c. 4 weeks/40° C. | No Phase Separation | No Phase Separation |
| d. 8 weeks/40° C. | No Phase Separation | No Phase Separation |
| Rheological Stability | | |
| a. 8 weeks/20° C. | Not Pourable | Pourable |
| b. 8 weeks/30° C. | Not Pourable | Pourable |
| c. 4 weeks/40° C. | Not Pourable | Pourable |
| d. 8 weeks/40° C. | Not Pourable | Pourable (but thickening) |

Analysis of the data provided in Table 6 indicates that the suspensions of the current invention are chemically, physically and rheologically stable over time and temperature. Additionally, the chemical stability and physical stability of the suspension of the current invention (Suspension 8B) are equal, or substantially equal, to those of Suspension 8A while Suspension 8B has the advantage of rheological superiority and stability.

We claim:

1. A pourable bleaching composition comprised of a solid, substantially water-insoluble organic peroxy acid stably suspended in an aqueous medium, said aqueous medium comprised of xanthan gum and a polymer selected from the group consisting of polyvinyl alcohol, one or more cellulose derivatives and mixtures thereof, said xanthum gum and said polymer present in amounts effective to provide a physically and chemically stable, pourable bleaching composition.

2. A composition of claim 1 wherein said polymer is a cellulose ether.

3. A composition of claim 1 wherein said polymer is selected from the group consisting of methyl cellulose, methyl hydroxypropyl cellulose, methyl hydroxybutyl cellulose, hydroxyethyl cellulose, carboxymethyl cellulose and mixtures thereof.

4. A composition of claim 1 wherein said solid, substantially water-insoluble organic peroxy acid has been coated with a water-impermeable material.

5. A composition of claim 4 wherein said water-impermeable material is selected from the group consisting of lauric acid, myristic acid and a mixture thereof.

6. A composition of claim 1 further comprising an electrolyte.

7. A composition of claim 6 wherein said electrolyte is sodium sulfate.

8. A composition of claim 1 wherein said organic peroxy acid is a diperoxy acid.

9. A composition of claim 8 wherein said diperoxy acid is 1,12-diperoxydodecanedioic acid.

10. A dilute suspension comprised of the composition of claim 1 and a diluent.

11. A dilute suspension of claim 10 wherein said diluent is water.

12. A pourable bleaching composition comprised of a solid, substantially water-insoluble organic peroxy acid stably suspended in an aqueous medium, said aqueous medium comprised of about 0.1 to about 1.0 wt. % of xanthan gum and about 0.02 to about 2.0 wt. % of polymer selected from the group consisting of polyvinyl alcohol, one or more cellulose derivatives and mixtures thereof.

* * * * *

UNITED STATES PATENT AND TRADEMARK OFFICE

CERTIFICATE OF CORRECTION

PATENT NO. : 5,126,066

DATED : June 30, 1992

INVENTOR(S) : Torenbeek et al.

It is certified that error appears in the above—identified patent and that said Letters Patent is hereby corrected as shown below:

item [56],

Under the heading, "Other Publications" on the Title page, publication three should be Xanthan Gum...;

Item [56] Under, Attorney, Agent or Firm, "David Vickery" should read, --David Vickrey--;

Column 1, line 32, insert --,-- after "mucilaginous materials";

Column 2, line 66, insert --.-- after "(e";

Column 8, line 64, please insert --a-- before "substantially";

Column 9, line 2, "3 5%" should read, --3.5%--; and

Signed and Sealed this

Nineteenth Day of October, 1993

Bruce Lehman

*Attest:*

BRUCE LEHMAN

*Attesting Officer*

*Commissioner of Patents and Trademarks*